US006000072A

United States Patent [19]

LaHay

[11] Patent Number: 6,000,072

[45] Date of Patent: Dec. 14, 1999

[54] SPA COVER REMOVER

[76] Inventor: Leon LaHay, 3939-244 Street, Langley, British Columbia, Canada, V2Z 2M1

[21] Appl. No.: 09/149,301

[22] Filed: Sep. 9, 1998

[51] Int. Cl.[6] ..... E04H 4/10

[52] U.S. Cl. ..... 4/498; 4/580

[58] Field of Search ..... 4/498, 580, 246.4, 4/246.3; 160/77, 81, 217; 296/100.18

[56] References Cited

U.S. PATENT DOCUMENTS 5,131,102 7/1992 Salley et al. ..... 4/498

5,634,218 6/1997 Ouelette ..... 4/498

*Primary Examiner*—Kathleen J. Prunner

[57] ABSTRACT

A spa cover remover has a pair of parallel side bars pivotably connected to opposite sides of a spa, and a cross-bar in the form of a roller extending between upper ends of the side bars. In use, a spa cover is folded over the cross-bar during removal from a spa, and the side bars and the cross-bar are then pivoted to lift the cover into an offset position. During such pivotation, rotation of the roller prevents stretching and consequential damage of the covering of the spa cover.

5 Claims, 2 Drawing Sheets

SPA COVER REMOVER

BACKGROUND OF THE INVENTION

1. Field of the Invention

The present invention relates to a spa cover remover for use in removing a cover from a spa.

2. Description of the Related Art

It is common practice to provide a spa, otherwise known as a hot tub, with an insulating cover which serves to retain heat in water in the spa and also to prevent leaves and other garbage from falling into the water in the spa when the spa is not in use.

Such spa covers are usually made with a filling of insulating material enclosed in a covering made of vinyl sheet material.

Also, such spa covers are usually made so that they can be folded in half to facilitate their removal from and installation onto the spa.

It has previously been proposed to provide a spa cover remover for facilitating the removal of the spa cover and the installation of the spa cover, the spa cover remover comprising a pair of side bars having lower ends pivotably connected to opposite respective sides of the spa and upper ends which are interconnected by a cross-bar. In use, when it is desired to remove the spa cover from the spa, the spa cover remover is pivoted to bring the cross-bar over the mid-section of the spa cover, the spa cover is then folded over the cross-bar, and the crossbar is then pivoted to carry the spa cover from the top of the spa to a position offset from the spa. In this position, the spa cover hangs substantially vertical from opposite sides of the cross-bar in a location adjacent the spa, and can be readily re-installed onto the spa, when required, by reversing the above procedure.

It has been found, in practice, that when such spa cover removers have been in use for a period of time, the vinyl covering of the spa cover exhibits a tendency to deteriorate prematurely, particularly at the mid-section of the cover.

BRIEF SUMMARY OF THE INVENTION

The present inventor has ascertained that such deterioration of the vinyl covering of the spa cover is caused by stretching of the vinyl covering, during the pivotation of the cross-bar to and from its offset position. This stretching is caused by the fact that the cross-bar, being fixedly connected to the side bars, and in relatively tight frictional engagement with the vinyl covering of the spa cover, stretches the vinyl covering during the pivotation of the cross-bar to and from its offset position.

It is accordingly an object of the present invention to avoid such stretching of the covering of the spa cover.

According to the present invention, there is provided a spa cover remover comprising a pair of parallel side bars at opposite sides of the spa, the side bars having lower ends pivotably connected to the spa, and a cross-bar extending between upper ends of the side bars. The cross-bar comprises a roller for rolling engagement with the spa cover, during pivotation of the cross-bar to and fro from an offset position, whereby stretching of the spa cover by the cross-bar during such pivotation is avoided.

In a preferred embodiment of the invention, the cross-bar comprises telescopically interengaged rod portions, with a sleeve extending around and rotatable around the rod portions. The sleeve is made of flexible plastic tubing, and by disengagement of the telescopically engaged rod portions, the spa cover remover can be readily disassembled to allow compact packaging and storage of the spa cover remover.

BRIEF DESCRIPTION OF THE DRAWINGS

The present invention will be more readily understood from the following description of a preferred embodiment thereof given, by way of example, with reference to the accompanying drawings, in which.

DESCRIPTION OF THE PREFERRED EMBODIMENT

Figure 1:
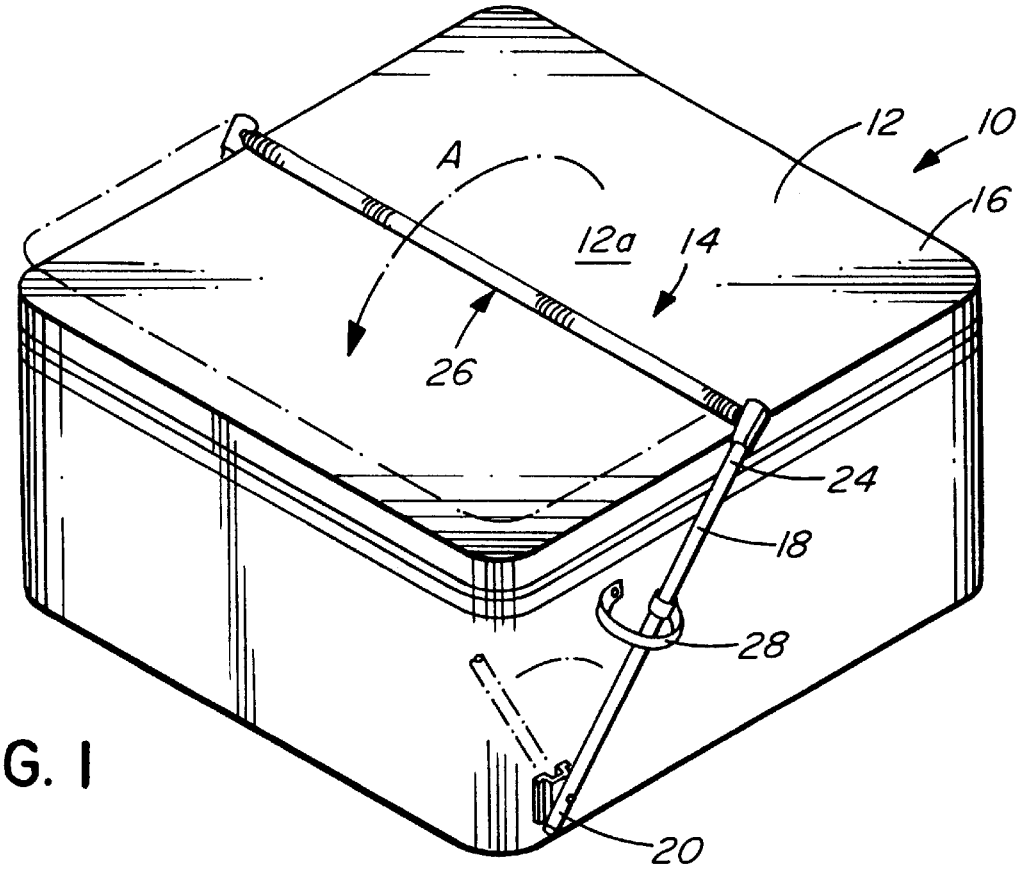
FIGS. 1 and 2 show views in perspective of a spa provided with a spa cover remover embodying the present invention.
Figure 2:
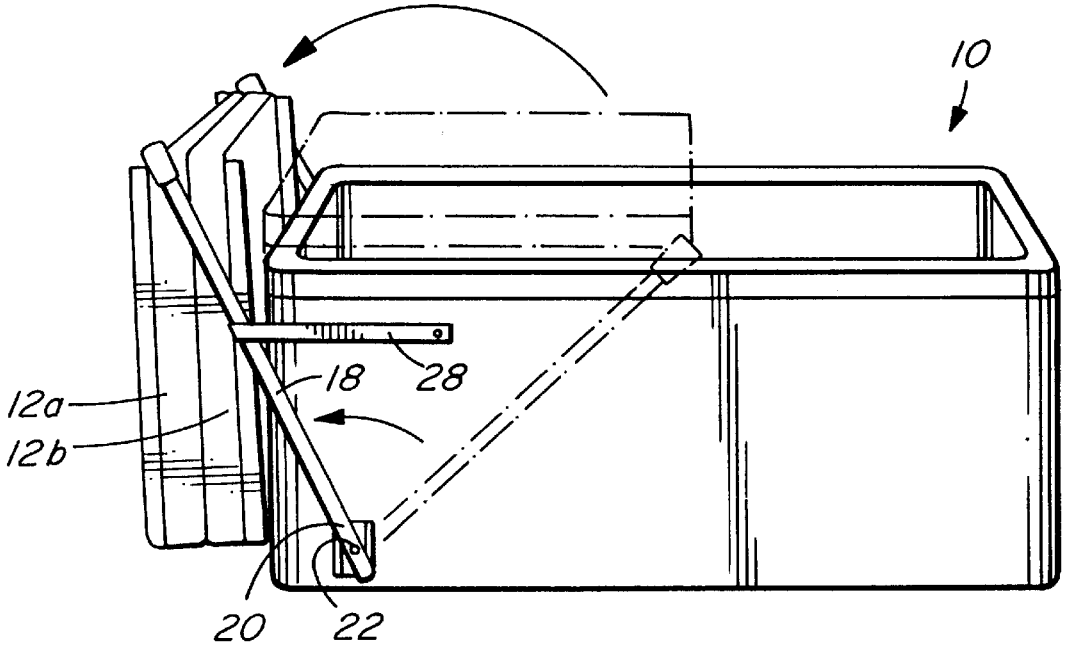

In FIGS. 1 and 2 there is shown a spa indicated generally by reference numeral 10, which is provided with a spa cover 12 and a spa cover remover indicated generally by reference numeral 14.

The spa 10 and the spa cover 12 are of conventional construction and, therefore, are not described in further detail herein, except to mention that the spa cover 12 includes an outer covering 16 of vinyl sheet material.

The spa cover remover 14 comprises a pair of side bars 18 having lower ends 20 pivotably connected by pivot connections 22 to opposite respective sides of the spa 10.

The side bars 18 have upper ends 24 which are interconnected by a cross-bar indicated generally by reference numeral 26, the arrangement being such that, by pivotation of the side bars 18, the cross-bar 26 can be pivoted from the position in which it is shown in FIG. 1 to an offset position, in which it is shown in FIG. 2. The pivotation of the side bars 18 is limited by a strap 28 connecting one of the side bars 18 to the spa 10.

In use, when it is desired to remove the spa cover 12 from the spa 10, the cross-bar 26 is pivoted into the position in which it is shown in FIG. 1 and in which it extends across a mid-portion of the spa cover 12. One-half 12*a* of the spa cover 12 is then raised, as indicated by arrow A in FIG. 1, while the other half 12*b* remains in position, so as to fold the spa cover 12 in halves over the cross-bar 26. The side bars 18 are then pivoted to correspondingly pivot the cross-bar 26 from the position in which it is shown in FIG. 1 to an offset position in which it is shown in FIG. 2. In this offset position, the two halves 12*a* and 12*b* of the spa cover 12 hang down vertically at opposite sides of the cross-bar 26.

The present inventor has found that with previously proposed spa cover removers, having a cross-bar 26 fixedly connected to the upper ends 24 of side bars 18, the removal of a spa cover 12 from a spa 10 in the above-described manner has resulted in stretching of the vinyl covering 16 of the spa cover 12 by its frictional engagement with the pivoting cross-bar 26 of the spa cover remover 14. This stretching of the vinyl covering 16 of the spa cover 12 results in premature cracking and splitting of the vinyl covering 16.

To avoid such premature damage to the spa cover 12, it is now proposed, according to the present invention, to form the cross-bar 26 as a roller, which can rotate relative to the side bars 18 during the pivotation of the cross-bar 26 to and fro into and from its offset position. This avoids tensioning and stretching of the vinyl covering 16 of the spa cover 12 by frictional engagement with the cross-bar 26 since the cross-bar 26 can rotate freely, as required, relative to the side bars 18 and in response to forces exerted on the cross-bar 26 by the vinyl material. The vinyl covering 16 is, therefore, not stretched and damaged.

Figure 3:
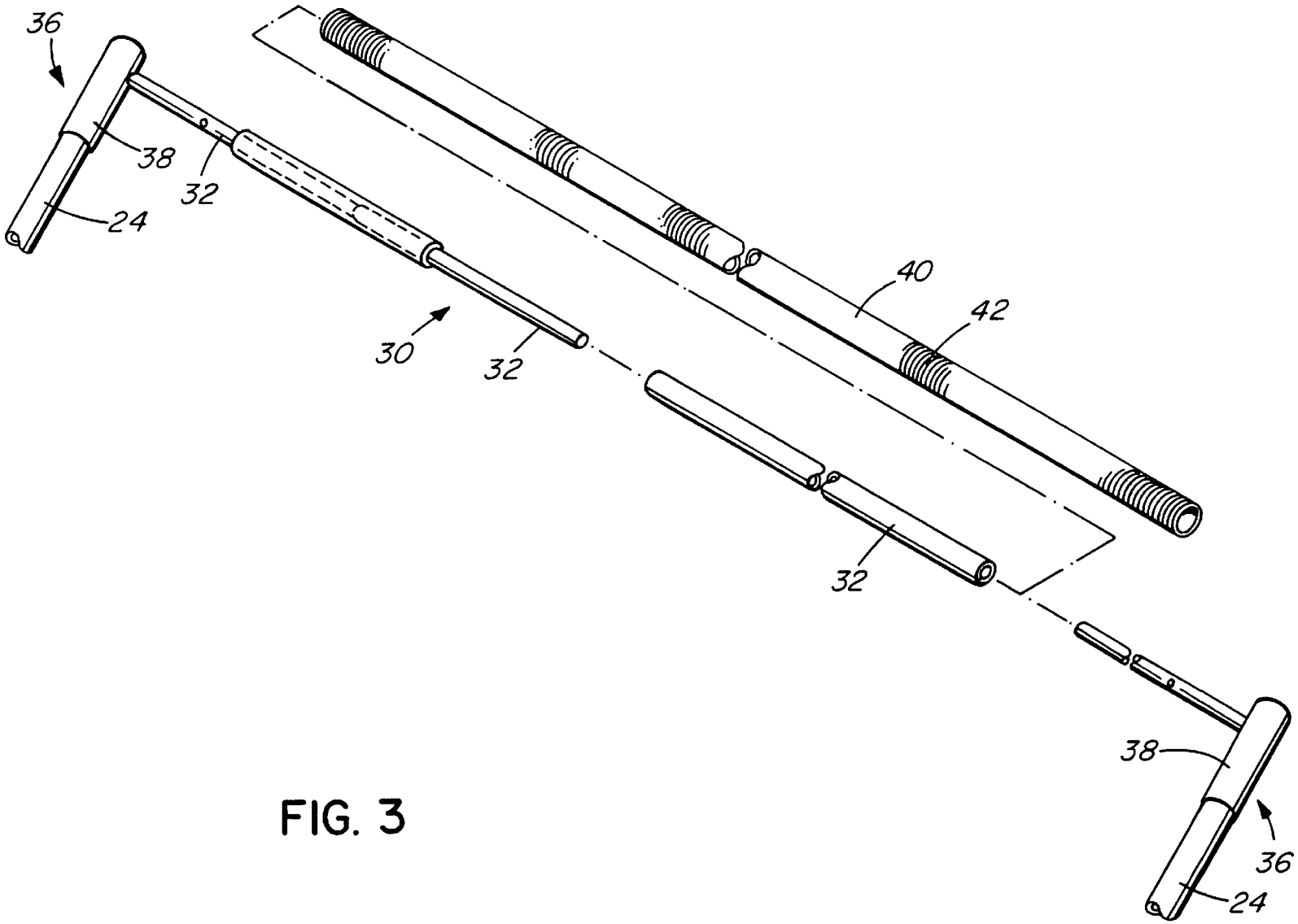
FIG. 3 shows a view in perspective of parts of the spa cover remover of FIGS. 1 and 2.

For this purpose, according to the present invention, the cross-bar 26 is constructed as shown in greater detail in FIG. 3.

More particularly, the cross-bar 26 comprises an inner rod, indicated generally by reference numeral 30 which is formed by telescopically interengaged rod portions 32. Opposite ends of the rod 30 are fixedly secured to upper ends 24 of the side bars 18 by means of connectors indicated generally by reference numeral 36. The connectors 36 include sleeve-shaped portions 38 which are fitted over the upper ends 24 of the side bars 18.

The cross-bar 26 also includes a sleeve 40, which extends around and is rotatable around the inner rod. In the present embodiment of the invention, this sleeve 40 is formed by a length of flexible plastic material formed with circumferentially extending annular ribs 42 which are axially spaced apart along the plastic tubing.

By disengaging the telescopically interengaged rod portions 32 and by removing them from the tubing, the present spa cover 12 remover can readily be disassembled for compact storage and transportation.

As will be readily apparent to those skilled in the art, various modifications of the present spa cover 12 remover may be made within the scope of the appended claims.

For example, instead of employing a one-piece sleeve 40, two or more separate cylindrical roller sleeve portions could be provided on the internal rod. Alternatively, the cross-bar 26, instead of being in the form of a sleeve 40 rotatable about a rod, could take the form of a roller rotatably connected at its opposite ends to the side bars 18.

I claim:

1. A spa cover remover, comprising:

a pair of parallel side bars at opposite respective sides of a spa;

said side bars having upper and lower ends;

a cross-bar extending between said upper ends of said side bars; and pivot connections between said spa and said lower ends of said side bars, said pivot connections allowing said cross-bar to pivot, with a spa cover folded over said cross-bar, to a position offset from above said spa, said spa cover being able to hang downwardly from said cross-bar when said cross-bar is in the offset position and including a covering, said cross-bar comprising a roller for rolling engagement with said spa cover, during the pivotation of said cross-bar to and from its offset position, whereby stretching of said covering by said cross-bar during such pivotation is avoided.

2. A spa cover remover as claimed in claim 1, wherein said roller comprises an inner rod extending between and fixed to said upper ends of said side bars and a cylindrical sleeve extending around and rotatable around said inner rod.

3. A spa cover remover as claimed in claim 2, further comprising connectors securing said cross-bar to said upper ends of said side bars, said connectors comprising sleeve-shaped portions fitted onto said upper ends.

4. A spa cover as claimed in claim 2, wherein said inner rod comprises telescopically interengaged rod portions.

5. A spa cover remover as claimed in claim 2, wherein said sleeve comprises a length of plastic tubing formed with circumferentially extending annular ribs spaced apart along said tubing.

* * * * *